United States Patent [19]

Balinski

[11] 3,974,607

[45] Aug. 17, 1976

[54] FIRE-RATED COMMON AREA SEPARATION WALL STRUCTURE HAVING BREAK-AWAY CLIPS

[75] Inventor: Henry A. Balinski, Hoffman Estates, Ill.

[73] Assignee: United States Gypsum Company, Chicago, Ill.

[22] Filed: Oct. 21, 1974

[21] Appl. No.: 516,302

[52] U.S. Cl. ..... 52/232; 52/1; 52/98; 52/621

[51] Int. Cl.[2] ..... E04C 2/00; E04B 1/40

[58] Field of Search ..... 52/1, 98–100, 52/202, 232, 615, 621; 49/7; 160/1

[56] References Cited

UNITED STATES PATENTS

| | | | |
|---|---|---|---|
| 1,151,289 | 8/1915 | Saino | 52/232 |
| 3,062,298 | 11/1962 | Nash | 49/7 X |
| 3,566,564 | 3/1971 | Gaeth et al. | 52/232 |
| 3,731,442 | 5/1973 | Kiyoshi | 49/7 |
| 3,807,106 | 4/1974 | Reinhardt et al. | 52/1 |
| 3,828,493 | 8/1974 | Vezmar | 52/1 |

*Primary Examiner*—J. Karl Bell

*Attorney, Agent, or Firm*—Samuel Kurlandsky; Donnie Rudd; Robert H. Robinson

[57] ABSTRACT

A common area separation wall structure for separating adjacent occupancy areas is provided having a centrally located vertical fire barrier member comprised of a plurality of steel studs supporting a plurality of gypsum drywall panels, and wood-framed wall structures on each side of the vertical fire barrier having outer wall panels affixed thereto. The fire barrier member is supported by the wall structures on each side and affixed thereto by means of aluminum break-away clips. In the event of a fire in one occupancy area, the heat of the flames melts the break-away clips on that side, permitting the burning wall to separate from the vertical fire barrier member and collapse, while the vertical fire barrier member remains supported by the opposite non-burning wall, thereby preventing the fire from igniting the wall structure of the occupancy area on the other side.

7 Claims, 5 Drawing Figures

FIRE-RATED COMMON AREA SEPARATION WALL STRUCTURE HAVING BREAK-AWAY CLIPS

BACKGROUND OF THE INVENTION

1. Field of Invention

The present invention relates to wall constructions, and more particularly refers to a common area separation wall structure for separating adjacent occupancy areas having means provided for preventing the spread of a fire originating in one occupancy area to the adjacent occupancy area.

2. Description of the Prior Art

The rising cost of building materials, labor, and mortgage interest is rendering it ever increasingly difficult for the average person to buy or rent an individual home. As a result, multiple unit dwellings such as apartments, townhouses, and condominiums have enjoyed increasing popularity and may in the future substantially replace the individual home as a dwelling place for low and middle income, and to some extent high income families. In spite of offering such real advantages in savings, multiple occupancy dwellings suffer the disadvantage of having common area separation walls between adjacent occupancy areas. The presence of such common wall structures increases the danger that a fire originating in one occupancy unit may spread through the common area separation wall structure to an adjacent occupancy unit.

In order to prevent the spreading of a fire from one occupancy unit to another, it has become conventional to utilize a masonry fire barrier within each common wall. This structure has reduced the hazard of fire spreading from one unit to another. However, it is very heavy and expensive to build, and building is invariably halted during inclement weather.

SUMMARY OF THE INVENTION

It is accordingly an object of the invention to provide a common wall structure for wood frame multiple occupancy buildings having a vertical fire barrier member intermediate the wood-framed walls of adjacent occupancy units.

It is a further object to provide a structure to permit burning walls and wood frame structures in an occupancy unit which has caught fire to separate from the vertical fire barrier member and collapse, thereby preventing the spread of the fire to the wall of an adjacent unit sharing the common wall structure.

Other objects and advantages will become apparent upon reference to the drawings and the detailed description.

According to the invention, a commonly shared party wall construction for multiple occupancy buildings having wood frame structures, such as apartment buildings, condominiums, and townhouses, is provided comprising a fire barrier member formed of a fire resistant material such as gypsum wall panels and supported by steel studs, and separately framed outer wall panels on both sides of the fire barrier member forming room walls for adjacent occupancy units. The fire barrier member is supported to the wood frames on both sides thereof substantially solely by means of break-away clips of a metal having a melting point sufficiently low to fail when subjected to the temperatures of a burning wall, such as aluminum. When the wall of one occupancy unit catches fire, the heat of the flame melts the break-away clips by which the fire barrier member is affixed to the wall frame and permits the burning wall to separate therefrom and collapse, thereby preventing spreading of the fire through the fire barrier member and into the outer wall and frame of the adjacent occupancy unit.

DESCRIPTION OF THE PREFERRED EMBODIMENTS

Figure 1:
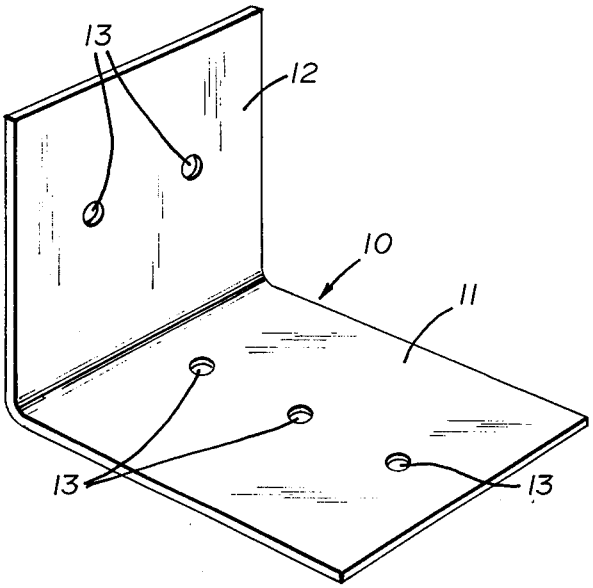
FIG. 1 is a perspective view of a break-away clip according to the invention.

Referring to FIG. 1 a break-away clip 10 according to the invention is shown comprising a body 11, a leg 12 disposed at a 90° angle thereto, and a plurality of apertures 13 through which screws or nails 32 may be inserted and driven into an adjacent structure.

Figure 2:
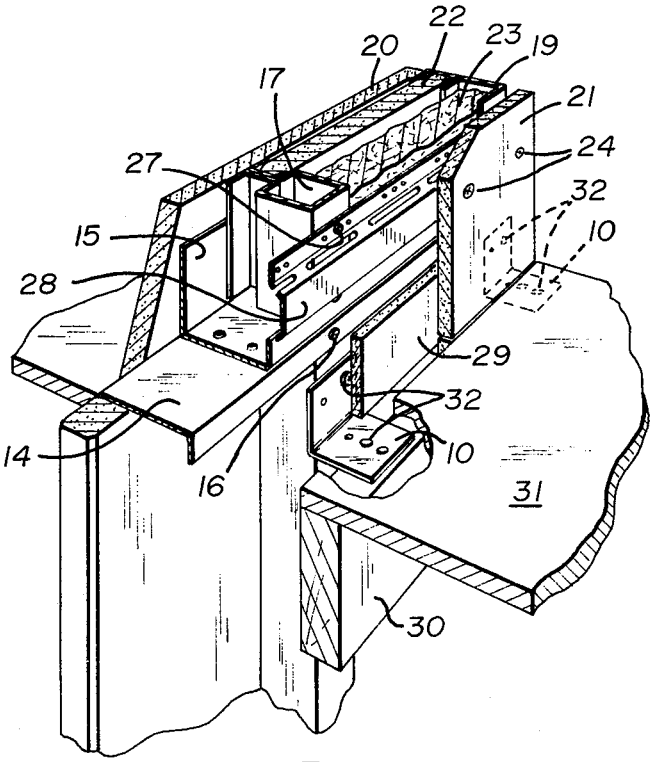
FIG. 2 is a fragmentary perspective view of a common wall structure according to the invention having a cavity-type vertical fire barrier.
Figure 3:
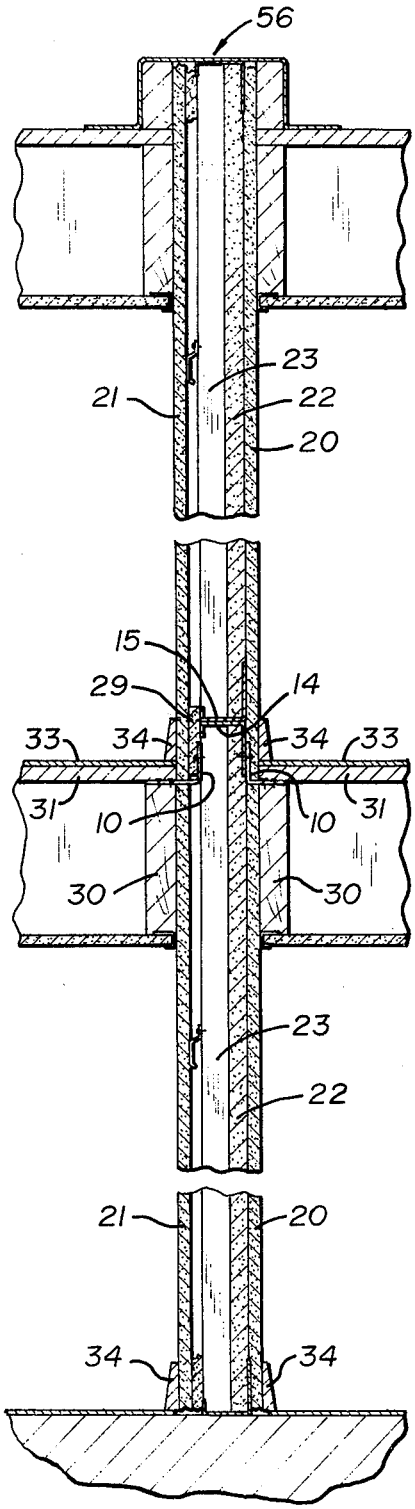
FIG. 3 is a fragmentary cross-sectional view of the structure shown in FIG. 2.

Referring to FIGS. 2 and 3 a common area separation wall structure is shown comprising ceiling runners 14, floor runners 15 and screws 16 affixing the adjacent runners together. A plurality of T-studs 17, sometimes termed "box-T studs" are mounted within the runners and affixed thereto by screws. At the end of the wall structure is an E-stud 19.

A plurality of outer wall or space panels 20 of a material such as ⅝ inch gypsum panel are affixed to flanges of the studs 17 by means of screws. Furring channels 28 are affixed to the box portion of the studs 17 by means of screws 27. Back blocking strips 29 are also affixed to the stud 17, and face panels 21 are affixed to the furring channel 28 and back blocking strip 29 by means of screws 24. A plurality of one inch thick gypsum panel fire barrier members 22 are mounted within channels provided in the T-stud 17. In order to provide sound insulation or attenuation a plurality of mineral wool batts 23 and furring channels 28 are mounted intermediate the studs 17. If sound insulation or attenuation is not desired, the furring channels 28 and wool batts 23 may be eliminated.

A plurality of the studs 17 are affixed to a plurality of wood joists on both sides of the fire barrier member 22 by means of break-away clips 10 of the invention. Screws 32 affix the clip to the joists 30 and the studs 17. Alternatively, the body portion of the clip may be affixed to the subflooring, although this is not the preferred structure. The clips are preferably formed of aluminum or an aluminum alloy. Other materials may be utilized such as various forms of plastic materials. The clips must be of a material which will burn or melt at the temperatures commonly encountered under fire conditions. Steel is not suitable since it does not give way under such fire conditions. The structure is finished by means of moldings 34.

Figure 4:
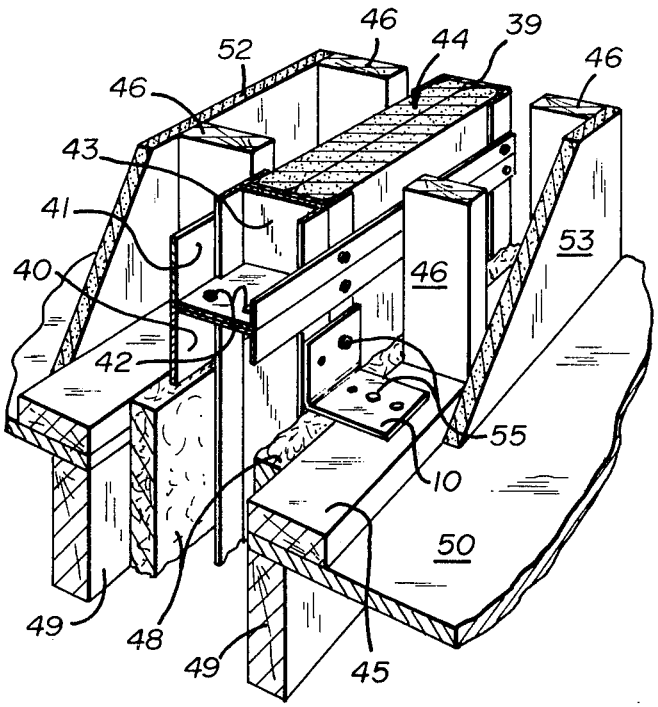
FIG. 4 is a fragmentary perspective view of an alternative embodiment of the invention utilizing a solid vertical fire barrier.
Figure 5:
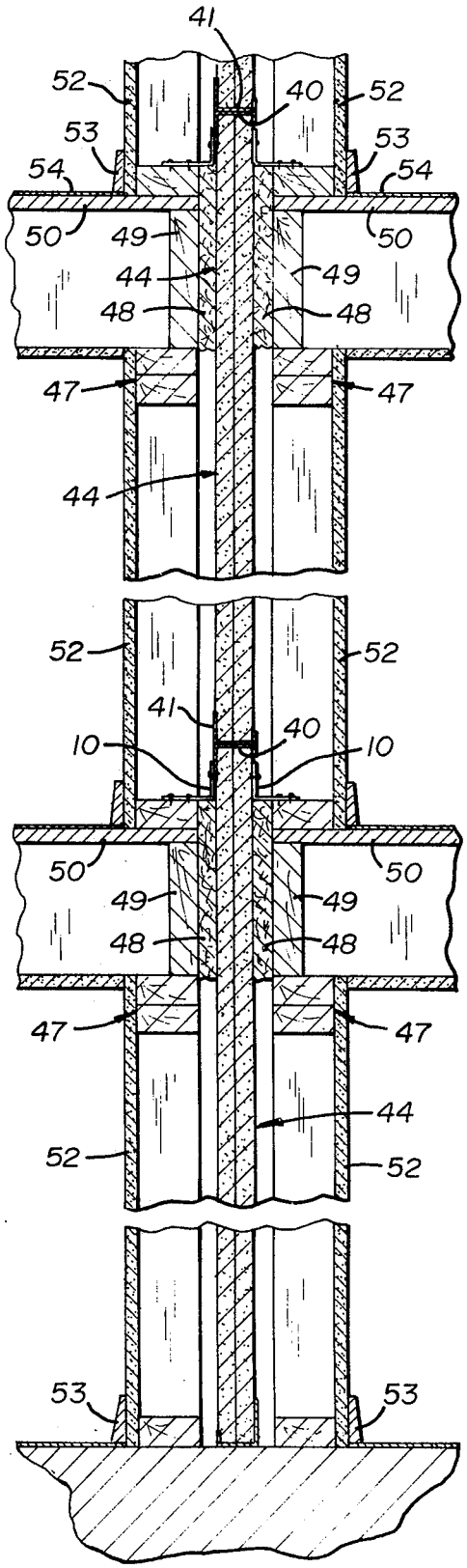
FIG. 5 is a fragmentary cross-sectional view of the structure shown in FIG. 4.

Referring to FIGS. 4 and 5, a structure comprising another embodiment of the invention is shown and comprises a plurality of ceiling runners 40, floor runners 41 and screws 42. A plurality of H-studs 43 formed by welding together a pair of channels are mounted within the runners 40 and 41. A two-ply laminated gypsum board is mounted in the channels formed by the H-studs. The frame on each side of the structure is formed by a plurality of base plates of 2×4 inch boards, studs 46 of 2×4 inch boards, and double ceiling plates 47 of 2×4 inch boards. The frame structure is supported by joists 49 affixed to the studs by means of the clips 10 or the invention by means of screws 55. Intermediate the joists and studs are fire blocking strips 48 of a material such as mineral wool. The clips 10 are affixed to the flanges of the H-studs 43 by screws 55 and are affixed to 2×4 inch base plates 45. Alternatively, they may be affixed to subflooring 50 or the joist 49. A parapet 56 covers the top of the fire barrier member.

The common area separation wall structure of the present invention has many advantages over structures previously utilized. For the most part prior art structures comprised heavy masonry walls with wood framing on either side, and plaster or wallboard face walls. Such structures are heavy and expensive to build.

In contrast, the present structure comprises a central structure of steel studs and gypsum board panels mounted thereon. The structure is light, strong, and, with the development of the break-away clip of the invention, provides protection against transmission of fire from one side of the common wall to the other. Of the embodiments illustrated above, the cavity type wall shown in FIGS. 3 and 4 comprises steel studs and gypsum liner panels set in steel runners and faced both sides with gypsum panels having suitable fire rating. Although not intended to be limiting in any respect, suitable walls may be made of gypsum liner panels one inch thick and erected vertically with ends set into 2½ inch steel J-runners and edges inserted into specially formed 2½ inch steel T-studs screw-attached to the runners. The J-runners are installed singly at top and bottom of wall and back-to-back between vertical liner panels on a line three inches above each intermediate floor. The aluminum clips of the invention which attach the studs to adjacent wood framing such as joists, 2×4 inch plate or stud structures or 2×4 inch studs, break away when exposed to fire, thus permitting a fire-damaged structure to fail while the fire barrier comprising one or more gypsum panel sheets mounted within the steel studs to remain intact. To improve sound transmission loss, mineral wool sound attenuation blankets are inserted in the stud cavity and resilient channels may be used to isolate the face layer. With 25-ga. steel T-studs spaced 24 inches o.c., the assemblies are suitable for floor-to-ceiling height of up to 11 feet without exceeding 1/240 allowable deflection under 5 p.s.f. lateral load.

With regard to the solid type wall as illustrated in FIGS. 4 and 5, a wall may comprise two one inch thick gypsum liner panels installed vertically between two inch steel J-runners. Panel edges are inserted in two inch steel H-stud spaced 24 inches o.c. and screw-attached to runners. The runners are preferable of the type shown in the drawings and designated J-runners, are installed at top and bottom of wall and back-to-back between vertical panels at a convenient height above each intermediate floor. T-studs are attached to wood framing with 16 ga. aluminum angle clips which break away when exposed to fire. They permit a fire-damaged structure to collapse without causing the fire barrier to fail. With 24-ga. steel H-studs, the assembly is suitable for floor-to-ceiling heights up to ten feet without exceeding 1/240 allowable deflection under 5-p.s.f. lateral load.

The wall structures of the invention, both the cavity type and the solid type provide excellent fire-resistive protection to adjoining properties. Both types offer two-hour fire rating under University of California tests. The cavity type offers a three-hour rating with an additional layer of ⅝ inch fire rated panels. Concealed openings in the construction are fire stopped at each floor/ceiling level to resist vertical spread of fire. The assemblies have sufficient structural stability under fire conditions to meet the fire-protection requirements of various code bodies.

The wall structures of the present invention, which are in fact simplified structures over those of the prior art, use low-cost materials and labor. They install faster than masonry walls usually used. Because they are lighter in weight (10 to 14 p.s.f for cavity types and 8 p.s.f. for solid types) less material has to be moved and handled during installation.

The area separation walls of the invention erect easily using procedures familiar to mechanics. Their dry construction permits installation in any kind of weather in which men normally work. The extra-thick gypsum liner panels with only one face layer each side install more quickly than other multi-layered drywall assemblies which provide equivalent fire resistance. Further, their use in place of masonry may eliminate one trade from the job. Projects move faster, schedules are met more easily, and buildings occupied sooner.

The structures of the present invention additionally adapt themselves well for providing economical sound control that helps apartments rent quicker with less turn over, and helps to sell condominiums faster. The cavity type wall, 3¾ inch wide, with single layer ⅝ inch face panels and 1 inch mineral wool sound attenuation blanket in the cavity offers 44 STC rating or 50 STC rating with RC-1 SHEETROCK (U.S Gypsum Company) resilient channels and 1½ inch blankets.

An additional feature of the present invention is that the wall structure has space-saving features which provide extra floor space in each unit. A standard thickness is 3¾ to 4¼ inch for cavity type separation walls compared to 8 to 12 inch for masonry wall without interior finish.

It is to be understood that the invention is not to be limited to the exact details of operation or structure shown and described in the specification and drawings, since obvious modifications and equivalents will be readily apparent to one skilled in the art.

I claim:

1. A fire-rated common area separation wall structure comprising:

1. a vertical fire barrier member comprising:
   a. floor and ceiling runners,
   b. a plurality of steel studs mounted in said runners having panel engaging means provided therein, and
   c. at least one layer of gypsum wall panels mounted intermediate said studs and engaged by said panel engaging means,
2. a pair of wood frames one on each side of said vertical fire barrier member having an outer wall member affixed thereto, and
3. a plurality of break-away clips formed of a metal which melts or burns when subjected to heat at the temperature of a burning wood frame wall, said clips being substantially the sole means connecting said steel studs to said wood frames on both sides of said vertical fire barrier member, whereby when one of said wood frame walls burns, the break-away clips connecting said fire barrier member to said burning wood frame wall fail, permitting said burning wood frame wall to fall away and collapse while said fire barrier member is retained by the wood frame wall on the other side thereof, thereby preventing the fire from the first wall from spreading to the second wall.

2. A wall structure according to claim 1, wherein said break-away clip is L-shaped, one portion thereof being affixed to said stud by means of screws disposed in apertures provided therein and the other portion thereof being affixed to said wood frames by means of screws disposed in apertures provided therein.

3. A wall structure according to claim 1, wherein said clip is comprised of aluminum or an aluminum alloy.

4. A wall structure according to claim 1, wherein said studs have a tubular portion terminating in flanges defining oppositely directed channels for receiving and engaging the edges of said gypsum wall panels.

5. A wall structure according to claim 4 having horizontal furring channels affixed to the tubular portion of said studs, and having mineral wool batts disposed intermediate said studs to provide sound absorption.

6. A wall structure according to claim 1, wherein said studs have an H-shaped cross-section, and two layers of gypsum board panels disposed in the channels defined by said studs.

7. A wall structure according to claim 2, wherein one portion of each break-away clip is affixed to joists comprising a portion of said wood frames.

* * * * *